US011351684B2

(12) United States Patent
Phoon

(10) Patent No.: US 11,351,684 B2
(45) Date of Patent: Jun. 7, 2022

(54) STATIONARY BLADE AND MANUFACTURING METHOD

(71) Applicant: KONINKLIJKE PHILIPS N.V., Eindhoven (NL)

(72) Inventor: Kin Fatt Phoon, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 180 days.

(21) Appl. No.: 16/652,694

(22) PCT Filed: Sep. 24, 2018

(86) PCT No.: PCT/EP2018/075731

§ 371 (c)(1),
(2) Date: Apr. 1, 2020

(87) PCT Pub. No.: WO2019/068492

PCT Pub. Date: Apr. 11, 2019

(65) Prior Publication Data

US 2020/0316793 A1 Oct. 8, 2020

(30) Foreign Application Priority Data

Oct. 2, 2017 (EP) ..... 17194280

(51) Int. Cl.
*B26B 19/06* (2006.01)
*B26B 19/38* (2006.01)
(Continued)

(52) U.S. Cl.
CPC ..... *B26B 19/3846* (2013.01); *B26B 19/063* (2013.01); *B26B 19/042* (2013.01); *B26B 19/044* (2013.01); *B26B 19/28* (2013.01)

(58) Field of Classification Search
None
See application file for complete search history.

(56) References Cited

U.S. PATENT DOCUMENTS 2,141,582 A 12/1938 Wimberger
2,151,965 A * 3/1939 Hanley ..... B26B 19/042 30/43.92
(Continued)

FOREIGN PATENT DOCUMENTS

CN 106346519 B † 1/2017
DE 959803 C 3/1957
(Continued)

OTHER PUBLICATIONS

International Search Report and Written Opinion dated Dec. 20, 2018 for International Application No. PCT/EP2018/075731 Filed Sep. 24, 2018.

*Primary Examiner* — Hwei-Siu C Payer

(57) ABSTRACT

The present disclosure relates to a method of manufacturing a stationary blade (102) and to a stationary blade (102), the method comprising providing a metal component (106), involving applying a first bending procedure, thereby forming a top wall (112) and two legs (114, 116) at opposite ends of the top wall (112) that are spaced away from one another in a longitudinal direction, wherein, subsequent to the bending procedure, each of the two legs (114, 116) is arranged at a first angle (α) with respect to the top wall (112), and wherein two bending edges (152, 154) are formed between the top wall (112) and the two legs (114, 116), providing a support insert (108) having a longitudinal extension ($l_s$) that is at least slightly greater than a receiving space ($l_b$) between the two bending edges (152, 154), joining the metal component (106) and the support insert (108), wherein the metal component (106) is at least slightly pretensioned due to the longitudinal extension ($l_s$) of the support insert (108), and applying a second bending procedure to the metal component (106), comprising further bending the two legs (114, 116), thereby arranging each of the two legs (114, 116) at a
(Continued)

second angle (*) with respect to the top wall (112) that is smaller than the first angle (α).

14 Claims, 8 Drawing Sheets

(51) Int. Cl.
*B26B 19/04* (2006.01)
*B26B 19/28* (2006.01)

(56) References Cited

U.S. PATENT DOCUMENTS

| | | | | |
|---|---|---|---|---|
| 2,184,757 | A | | 12/1939 | Samotey |
| 2,249,825 | A | | 7/1941 | Hanley |
| 2,251,577 | A | | 8/1941 | Rand |
| 2,256,029 | A | | 9/1941 | Knapp |
| 2,266,885 | A | | 12/1941 | Martin |
| 2,290,326 | A | | 7/1942 | Hanley |
| 2,948,063 | A | * | 8/1960 | Jepson ..... B26B 19/042 30/34.1 |
| 10,857,686 | B2 | * | 12/2020 | Wu ..... B26B 19/046 |
| 2018/0257248 | A1 | | 9/2018 | Wu |
| 2020/0164533 | A1 | * | 5/2020 | Phoon ..... B26B 19/12 |
| 2020/0316793 | A1 | * | 10/2020 | Phoon ..... B26B 19/063 |
| 2020/0316794 | A1 | * | 10/2020 | Phoon ..... B26B 19/06 |

FOREIGN PATENT DOCUMENTS

| | | | |
|---|---|---|---|
| FR | 2531365 | | 2/1984 |
| WO | 2013/150412 | | 10/2013 |
| WO | 2016/001019 | | 1/2016 |
| WO | 2016/042158 | | 3/2016 |
| WO | WO 2018/068353 | * | 4/2018 |

* cited by examiner
† cited by third party

STATIONARY BLADE AND MANUFACTURING METHOD

CROSS REFERENCE TO RELATED APPLICATIONS

This application is the U.S. National Phase application under 35 U.S.C. § 371 of International Application No. PCT/EP2018/075731 filed Sep. 24, 2018, published as WO 2019/068492 on Apr. 11, 2019, which claims the benefit of European Patent Application Number 17194280.8 filed Oct. 2, 2017. These applications are hereby incorporated by reference herein.

FIELD OF THE INVENTION

The present disclosure relates to a method of manufacturing a stationary blade for a blade set of a hair cutting appliance and to a respectively arranged stationary blade and blade set. More generally, but not to be understood in a limiting sense, the present disclosure relates to the manufacture and design of so-called double-walled stationary blades for hair cutting appliances that include a first, top wall and a second, bottom wall that define therebetween a guide slot in which a movable blade is accommodated. More particularly, but not to be understood in a limiting sense, the present disclosure relates to improvements in sheet metal processing in the manufacture of stationary blades.

BACKGROUND OF THE INVENTION

WO 2013/150412 A1 discloses a stationary blade for a blade set of an electrically operated hair cutting appliance, the blade including a first wall and a second wall, each wall defining a first surface, a second surface facing away from the first surface, and a laterally extending leading edge defining a plurality of laterally spaced apart longitudinally extending projections, wherein the first surfaces of the first and second walls face each other, at least at their leading edges, while facing projections along the leading edges of the first and second walls are mutually connected at their tips to define a plurality of generally U-shaped teeth, and the first surfaces of the first and second walls define a laterally extending guide slot for a movable blade of said blade set between them, wherein the projections of the first wall have an average thickness that is less than an average thickness of the projections of the second wall.

Manufacturing approaches to double walled stationary blades are disclosed in WO 2016/001019 A1 and WO 2016/042158 A1 that describe arrangements wherein at least the top wall of the stationary blade is at least substantially made from sheet metal material. In both documents, an integral design of metal parts and non-metal parts is proposed, involving integrally manufacturing sheet metal and injection molding parts. Hence, insert molding and/or overmolding are proposed to combine the benefits of metal components and non-metal molded components.

CN 106346519 A discloses a blade set for a cutter head of a shaver, the blade set comprising a fixed blade that is provided with a toothed leading edge, a fixed blade bracket for supporting and securing the fixed blade, and, at an inner side of the fixed blade, a moving blade having corresponding teeth, wherein the moving blade can move back and forth relative to the fixed blade to cut hair, and wherein the fixed blade is a flexible metal sheet that is tensioned and secured at the fixed blade bracket. CN 106346519 A further proposes to tension the flexible metal sheet by the fixed blade bracket similar to a bowstring. To this end, it is further proposed to fold the flexible metal sheet around front and rear edges of the fixed blade bracket, and to secure the folded flexible metal sheet at the fixed blade bracket by any of welding, riveting and bonding.

Cutting appliances are well known in the art. Cutting appliances may particularly involve hair cutting appliances. In a more general context, the present disclosure addresses personal care appliances, particularly grooming appliances. Grooming appliances involve, but are not limited to, hair cutting appliances, particularly trimming appliances, shaving appliances, and combined (dual-purpose or multi-purpose) appliances.

Hair cutting appliances are used for cutting human hair, and occasionally animal hair. Hair cutting appliances may be used for cutting facial hair, particularly for shaving and/or for beard trimming. Further, cutting appliances are used for cutting (involving shaving and trimming) head hair and body hair.

In the trimming mode, the hair cutting appliance is typically equipped with a so-called spacing comb that is arranged to space away the blade set of the hair cutting appliance from the skin. Depending on the effective (offset) length of the spacing comb, a remaining hair length after the trimming operation may be defined.

Hair cutting appliances in the context of the present disclosure typically comprise a cutting head which may be referred to as processing head. At the cutting head, a blade set is provided, the blade set comprising a so-called stationary blade and a so-called movable blade. When the hair cutting appliance is operated, the movable blade is moved with respect to the stationary blade which may involve that respective cutting edges cooperate with one another to cut hair.

Hence, in the context of the present disclosure, a stationary blade is arranged to be attached to the hair cutting appliance in such a way that a drive unit thereof is not cooperating with the stationary blade. Rather, the drive unit is typically coupled with the movable blade and arranged to set the movable blade into motion with respect to the stationary blade. Hence, the stationary blade may be, in some embodiments, fixedly attached to a housing of the hair cutting appliance.

However, in alternative embodiments, the stationary blade is arranged at the housing of the hair cutting appliance in a pivotable fashion. This may for instance enable a contour-following feature of the cutting head of the hair cutting appliance. Therefore, the term stationary blade, as used herein, shall not be interpreted in a limiting sense. Further, needless to say, when the hair cutting appliance as such is moved, also the stationary blade is moved. However, the stationary blade is not arranged to be actively actuated to cause a cutting action. Rather, the movable blade is arranged to be moved with respect to the stationary blade.

The stationary blade may also be referred to as guard blade. Typically, when the hair cutting appliance is operated to cut hair, the stationary blade is, at least in part, arranged between the movable blade and the hair or skin of the user. As used herein, the term user shall refer to a person or subject whose hair is being processed or cut. In other words, the user and the operator of the hair cutting appliance are not necessarily one and the same person. The term user may also involve a client at a hairdresser or barber shop.

In some aspects, the present disclosure relates to hair cutting appliances that are capable of both trimming and shaving operations. In this context, hair cutting appliances are known that incorporate a dual cutting arrangement including a first blade set that is suitably configured for trimming and a second blade set that is suitably configured for shaving. For instance, the shaving blade set may include a perforated foil that cooperates with a movable cutting element. Rather, the trimming blade set may include two blades that are respectively provided with teeth that cooperate with one another. In principle, the perforated foil that forms the stationary part of the shaving blade set may be much thinner than the stationary blade of a trimming blade set which, primarily for strength reasons, must be considerably thicker in conventional appliances.

The above WO 2013/150412 A1 proposes to provide the stationary blade with two walls, one of which is facing the skin of the user and the other one facing away from the user. The two walls are connected to one another and define, in a lateral view, a U-shaped profile that forms a guide slot for a movable cutter blade. Hence, the stationary blade is a double-walled blade. This has the advantage that the first wall may be arranged in a considerably thinner fashion as the second wall provides the stationary blade with sufficient strength. Therefore, such an arrangement is suitable for trimming, as respective teeth may be provided at the stationary blade and the movable blade. Further, the blade set is suitable for shaving as the effective thickness of the first wall of the stationary blade is considerably reduced.

Hence, several approaches to the manufacture of double-walled stationary blades and respective blade sets have been proposed. However, at least some of the above-indicated approaches still involve relatively high manufacturing costs, particularly molding costs and tooling costs. In particular, a combined sheet metal and injection molding approach, that involves insert molding or overmolding techniques, requires specific tools and manufacturing facilities. Further, relatively complex and cost-increasing auxiliary processes may be required, for instance grinding, lapping, deburring, etc.

Hence, in this respect, there is still room for improvement in the manufacture of blade sets for hair cutting appliances.

It has been observed, however, that sheet metal processing, particularly sheet metal bending and/or folding are relatively inaccurate manufacturing methods, given the achievable tolerance zones and accuracies. A main issue in this context is that the sheet metal material is considerably resilient and elastic so that whenever a bending procedure is applied a certain rebound force is generated. Hence, to achieve a target bending state, a bending movement/deformation has to be induced having a greater scale than the target deformation of the involved sheet metal component.

To achieve a high cutting performance, it is necessary to ensure a tight and close contact between cutting edges of teeth of the involved stationary blade and the movable blade. Therefore, it is crucial to avoid undesired deformations on the part of the stationary blade, particularly the top wall thereof that is facing the skin when the blade set is operated. It is therefore desired to produce stationary blades having only a small insignificant residual deformation in the shape of the top wall that results from the bending/folding procedure.

Hence, in this respect, there is still room for improvement in the manufacture of blade sets for hair cutting appliances.

SUMMARY OF THE INVENTION

It is an object of the present disclosure to provide a method of manufacturing a stationary blade that is composed of a metal component and a support insert, wherein the metal component is folded to form a receiving contour for the support insert. Preferably, the metal component is deformed in such a way that in the final assembly state of the stationary blade a basically flat or otherwise desired target shape of a top wall of the metal component can be achieved that is within a considerably narrow tolerance zone. It is desired to provide a stationary blade that is dimensionally stable and that does not involve unwanted deformations in the final assembly state. However, at the same time, it is desired to utilize rather conventional and cost-efficient manufacturing and assembly procedures to produce the stationary blade.

It is a further object of the present disclosure to present a novel approach to the manufacture of a composite stationary blade that is an assembled unit comprising a metal component and a support insert, wherein the support insert is preferably made from another material and/or obtained from another manufacturing process. Preferably, in the final assembly state, the top wall of the metal component of the stationary blade provides a flat and even contact zone in the region of stationary blade teeth which may be abutted by teeth of the movable blade that is housed within the guide slot defined by the stationary blade. In this way, a powerful and efficient blade set may be provided.

It is a further object of the present disclosure to provide a stationary blade and a respectively equipped blade set for a hair cutting appliance that are manufactured in accordance with at least some aspects as discussed herein.

In a first aspect of the present disclosure there is presented a method of manufacturing a stationary blade for a blade set of a hair cutting appliance, the method comprising:

providing a metal component, comprising:

providing a sheet-metal blank, forming at least one pattern of slots in the sheet-metal blank, applying a first bending procedure, thereby forming a top wall and two legs at opposite ends of the top wall that are spaced away from one another in a longitudinal direction, wherein, subsequent to the first bending procedure, each of the two legs is arranged at a first angle with respect to the top wall, and wherein two bending edges are formed between the top wall and the two legs, providing a support insert having a longitudinal extension that is at least slightly greater than a receiving space between the two bending edges, joining the metal component and the support insert, wherein the metal component is at least slightly pretensioned in the longitudinal direction, due to the longitudinal extension of the support insert, applying a second bending procedure to the metal component, comprising further bending the two legs, thereby arranging each of the two legs and a second angle with respect to the top wall that is smaller than the first angle, wherein the second bending procedure at least partially compensates an intermediate deformation of the top wall that is caused by the pretensioning of the metal component.

This aspect is based on the insight that a two-stage bending procedure applied to the metal component may be used to account for rebound forces that are anyway involved in bending procedures. In other words, the first bending procedure may be applied to deliberately induce a shape of the top wall of the metal component that deviates from the target shape. Due to the second bending procedure, a basically opposite deformation may be induced that results in a final shape of the top wall that meets the desired tolerance zone. By way of example, the first bending procedure may induce an inward doming of the top wall of the metal component. By contrast, the second bending procedure may induce an outward doming. As the outward doming occurs in the second bending procedure in an already deformed top wall, a compensating deformation may be induced.

In accordance with the above aspect, the second bending procedure is applied in an intermediate assembly state where the metal component already engages the support insert. The support insert may so to say act as a bending tool in the second bending procedure.

Further, in accordance with the above-described method, between the first bending and the second bending procedure, the metal component and the support insert are fitted onto one another. This may involve an intermediate deformation/bending procedure as the support insert is designed to be slightly too large for an unbiased assembly with the metal component. In other words, a receiving space formed as the metal component in which the support insert is placed is smaller in size than the corresponding extension of the support insert. This induces a certain deformation of the metal component that has a main deformation direction that is opposite to the main direction of the subsequent deformation induced by the second bending procedure.

The multiple-stage manufacturing and assembly procedure may be adjusted in such a way that in the final assembly state the top wall of the metal component exhibits the target shape.

Between the first and the second bending procedure, the metal component is basically resiliently deformed. In other words, when the metal component would be detached from the support insert again, the metal component would exhibit the intermediate state obtained from the first bending procedure.

The support insert acts as a bending tool for the second bending procedure. More particularly, the support insert provides bending shoulders for the bending edges of the metal component. Hence, the two legs of the metal component are bent further in the second bending procedure, whereas the bending involves a bending about the shoulders provided by the support insert.

As used herein, the angles that define the intermediate and final orientation of the two legs with respect to the top wall are inner angles between opposite facing walls of the top wall and the two legs, respectively. In other words, the bending angle that describes the bending movement of two legs with respect to the top wall is a respective complementary angle (overall bending angle). In accordance with the afore-mentioned, the first, intermediate angle is generally between 0° and 90°. The second, final bending angle is smaller than the first angle, i.e. the respective legs approach the opposite faces of the top wall. For instance, the first angle is in the range of between 45° and 75°, preferably at about 60°. For instance, the second bending angle in this exemplary embodiment is in the range of about 15° to 45°, preferably at about 30°. These exemplary values are not to be understood in a limiting sense.

At the beginning of the manufacturing procedure, the sheet metal blank may be totally flat. After the first bending procedure, the metal component may assume a bracket-like shape including the top wall and the two opposite legs. The formation of the two bending edges may involve the formation of two respective series of tooth components that are defined by the pattern of slots formed in the sheet metal blank. The two legs are oriented towards one another (or face one another) in their final assembly state.

The support insert is sufficiently stiff to accommodate the mounting forces applied thereto by the metal component. This may be achieved even though the support insert may be obtained from plastic material as the support insert is arranged at the bottom side of the stationary blade and may be therefore much thicker than the metal component.

The receiving space between the two legs of the metal component is defined by the first bending procedure. In other words, a bending tool may be used for the first bending procedure that ensures that the receiving space is slightly smaller than the corresponding longitudinal extension of the support bracket.

The bending edges may also be referred to as folded edges herein. In the final assembly state, the bending edges are folded about shoulders defined by the support bracket.

Due to the compensating second pending procedure, unwanted doming of the top wall may be avoided. It is to be noted in this context that after the second bending procedure, the two legs of the metal component may be at least slightly deformed, for instance outwardly curved. Hence, it is not necessary to ensure a large contact zone between the two legs and their opposite contact faces at the support insert.

In an exemplary embodiment of the method, the step of joining the metal component and the support insert induces the intermediate deformation of the top wall, wherein the second bending procedure induces an opposite deformation. As two opposite deformations are induced, a compensating and leveling effect may be achieved.

In yet another embodiment of the method, the top wall, subsequent to the step of joining the metal component and the support insert and prior to the second bending procedure, is inwardly domed, when viewed in a cross-sectional plane perpendicular to a lateral direction. As used herein, for orientation purposes, a longitudinal direction, a lateral direction and a vertical direction will be referred to. The two bending edges at the metal component are spaced away from one another in the longitudinal direction. The stationary blade teeth form a series of teeth extending in the lateral direction. The top wall of the metal component and the support insert, particularly a central portion thereof, are spaced away from one another in the vertical direction in the assembled state.

Hence, when the top wall is inwardly domed, a concave deformation is present at the top end of the blade set that is facing the skin when the blade set is in operation for cutting hair.

In yet another embodiment of the method, the top wall, subsequent to the second bending procedure, is basically planar, when viewed in a cross-sectional plane perpendicular to a lateral direction. As indicated above, the target shape may also deviate from a planar shape. However, for many embodiments, an even and flat shape of the top wall is desired. As already discussed above, the two legs of the metal component may assume an at least slightly curved shape, subsequent to the second bending procedure.

In still another exemplary embodiment of the method, the two legs are urged against the support insert in the second bending procedure. In this way, a certain counterforce is induced which results in the compensating deformation at the top wall.

In yet another exemplary embodiment of the method, the support insert comprises two side arms and a central portion extending therebetween, wherein the side arms are inclined and arranged at an angle with respect to the central portion that defines the target position for the two legs of the metal component. Preferably, the two legs of the metal component and the side arms of the support insert are basically aligned in the final assembly state. As discussed above, a certain curvature may be present at the two legs after the second bending procedure.

In a lateral cross-sectional view, the support insert may be bracket-like and/or trough-like. Hence, in the final assembly state, the top wall of the metal component preferably spans the space between the two side arms, thereby defining the guide slot for the movable blade. In an exemplary embodiment, the two arms of the support insert are inclined with respect to a main extension direction of the central portion by an angle of about 30°. To match this arrangement, the two legs of the metal component are inclined with respect to a main orientation of the top wall by an angle of about 150° that is the complementary angle to the second angle exhibited after the second bending procedure. In other words, in the assembled state, the two side arms of the support insert are directed away from one another. By contrast, the two legs of the metal component are directed towards one another. The two legs of the metal component embrace the two side arms of the support insert.

In still another exemplary embodiment of the method, subsequent to the second bending procedure, the legs of the metal component are secured at the support insert. This may involve only a partial attachment of the two legs. For instance, an outermost portion or end portion of the legs (opposite to the top wall) may be attached to the support insert by one of bonding, welding, soldering, force-fitting, positive-fitting, snap-connecting, etc.

As discussed above, to achieve the desired shape at the top wall, a certain deformation at the legs may be acceptable. Hence, a local contact between the two legs and the support insert is sufficient.

In yet another exemplary embodiment of the method, the first bending procedure and the second bending procedure form stationary blade teeth, particularly stationary blade teeth that are, when viewed in a cross-sectional plane perpendicular to a lateral direction, substantially U-shaped or V-shaped and that are respectively formed by the top wall and one of the opposite legs. In the interior space of the stationary blade teeth, the corresponding teeth of the movable blade are accommodated.

Also the support insert may contribute to the formation of the stationary blade teeth as tooth stems may be provided thereon at the side arms. Preferably, two opposite parallel leading edges that are provided with a respective series of stationary blade teeth are formed at the two opposite longitudinal ends of the stationary blade.

In still another exemplary embodiment of the method, the metal component and the support insert form therebetween a guide slot for a movable blade.

Major aspects and insights of the present disclosure are discussed herein with reference to a target design of the top wall (first wall) of the metal component that is preferably flat and even. It is to be noted in this context that the target design may also involve an at least slightly curved shape of the top wall of the metal component. Hence, whenever reference is made to a preferably planar and even shape of the top wall, this should not be interpreted in a limiting sense. Rather, in line with major aspects of the present disclosure, stationary blades may be manufactured having metal components that are accurately shaped and dimensionally stable.

In another aspect of the present disclosure there is presented a stationary blade for a blade set of a hair cutting appliance, comprising:

a metal component obtained from a sheet metal blank, a support insert, wherein the metal component is folded around the support insert and forms a first folded edge at a first longitudinal end and a second folded edge at a second longitudinal end, where the metal component comprises a top wall and two opposite legs at opposite ends of the top wall that are spaced away from one another in a longitudinal direction, wherein the support insert is retained between the top wall and the two legs, wherein the metal component and the support insert form therebetween a guide slot for a movable blade, wherein, at the folded edges, at least one series of metal teeth is formed by the metal component, wherein tooth stems provided at the support insert form shoulders for the folded edges, wherein the top wall is pretensioned in a longitudinal direction by the support insert, and wherein the first leg and the second leg are bent about the shoulders in such a way that a deformation of the top wall due to the pretensioning is at least partially compensated so that the top wall is basically planar.

This aspect is based on the insight that the stationary blade may be manufactured by a combined multiple-stage process that provides for specifics of sheet metal processing. As indicated above, approaches to deform the metal component may involve bending, folding, etc. Respective material processing methods are generally subject to certain tolerances. In other words, bending, folding and similar processing methods for sheet metal parts often do not result in high-precision parts, but involve certain relatively large tolerances.

By using the resiliency, elasticity and rebound forces resulting therefrom, a desired final shape of the stationary blade may be achieved even though relatively simple manufacturing approaches are used.

Preferably, the support insert and the metal component that form at least a fundamental portion of the stationary blade each are easy to manufacture and, to form the stationary blade, easy to assemble and to be attached to one another.

The top wall may also be referred to as first wall. The two legs form a second, bottom wall. The first, top wall and the second wall may be parallel to one another, and/or inclined with respect to one another. Further, also at least partially curved shapes at at least one of the walls may be envisaged. All these alternatives may form a double-walled arrangement having a first wall and a second wall that are facing away from one another.

In some embodiments, the metal component is based on a sheet metal blank that is deformed to form a U-shaped or a V-shaped arrangement at the respective toothed leading edges. This may involve bending or folding respective sections of the originally flat sheet metal component. In other words, at least in some embodiments, sections of the original sheet metal blank are wrapped around the support insert, thereby forming the first wall, the second wall, and the leading edge at the transition therebetween.

Generally, the stationary blade may also be referred to as guard blade. Generally, the movable blade may also be referred to as cutter blade.

The top side of the guide slot that is facing the skin when the blade set is in operation is delimited by the first wall of the stationary blade. In other words, the movable blade cooperates with the first wall, particularly with the portions of the stationary blade teeth that are formed at the first wall, to cut hair.

The support insert may be obtained from a molding process, particularly from injection molding. However, in some alternative embodiments, the support insert may be obtained from a casting process that processes metal material. Further, the support insert may be obtained by machining an intermediate part to form the desired final shape.

However, in major embodiments of the present disclosure, the support insert is a plastic part that is obtained from a relatively simple injection molding procedure. Preferably, complex combined manufacturing procedures such as insert molding, overmolding, multi-component molding, etc. may be avoided.

The metal component and the movable blade may be obtained from sheet-metal machining.

In an exemplary embodiment of the stationary blade, the first leg and the second leg, in their assembled state, are preloaded so that a compensating bending movement acts on the top wall. This is caused by rebound forces that are induced by the bending procedure applied to the two legs of the metal compound. The rebound force is also present at the top wall to induce the compensating movement.

In a further exemplary embodiment of the stationary blade, the legs of the metal component are secured at the support insert. In another exemplary embodiment of the stationary blade, the legs of the metal component are, at their end portions, sectionally bonded to the support insert, wherein an adjacent portion of the legs is at least sectionally outwardly domed so that a clearance between the domed section and the support insert is present.

In yet another exemplary embodiment of the stationary blade, the support insert comprises two side arms and a central portion extending therebetween, wherein the side arms are inclined and arranged at an angle with respect to the central portion that defines the target position for the two legs of the metal component.

In yet another aspect of the present disclosure there is presented a blade set for a hair cutting appliance, the blade set comprising:

a stationary blade arranged in accordance with at least one embodiment as discussed herein, and a movable blade comprising a plurality of movable blade teeth, wherein the movable blade is movably retained between the metal component and the support insert in the assembled state, particularly in an undetachable manner, and wherein the movable blade and the stationary blade are arranged to be moved with respect to another to cut hair.

In yet another aspect of the present disclosure there is presented a hair cutting appliance arranged to be moved through hair to cut hair, the appliance comprising:

a housing comprising a handle section, a drive unit arranged in the housing, and a cutting head comprising a blade set in accordance with at least one embodiment as described herein.

Generally, the blade set may comprise a basically linear leading edge defined by a respective series of stationary blade teeth (and movable blade teeth). In accordance with this embodiment, a basically reciprocating and substantially linear relative movement between the movable blade and the stationary blade is present. However, this does not exclude embodiments, wherein an at least somewhat curved (oscillatory) movement path of the movable blade with respect to the stationary blade is present. This may be caused, for instance, by a respective guiding linkage for the movable blade.

Further, in addition to basically linear arrangements of blade sets, also curved or even circular arrangements of blade sets may be envisaged. Hence, accordingly, a somewhat curved or circular leading edge defined by a respective arrangement of stationary blade teeth (and movable blade teeth) may be provided. Therefore, whenever reference herein is made to a longitudinal direction, a lateral direction and/or a height direction, this shall not be interpreted in a limiting sense. A curved or circular blade set may be defined and described with reference to similar directions, but also with reference to polar directions and/or further appropriate directional information. Hence, Cartesian coordinate systems, but also polar coordinate systems and further appropriate coordinate systems may be used to describe linear and/or curved designs of blade sets.

In some embodiments, the blade set is provided with two opposite leading edges, i.e. two opposite series of stationary blade teeth and movable blade teeth. In this way, both a pulling and a pushing movement of the blade set may be used for the cutting operation. Further, in this way the hair cutting appliance can be deployed more flexible which may facilitate styling operations and hair cutting operations in hard-to-reach areas.

Further preferred embodiments are defined in the dependent claims. It shall be understood that the claimed method has similar and/or identical preferred embodiments as the claimed device(s) and as defined in the dependent claims.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
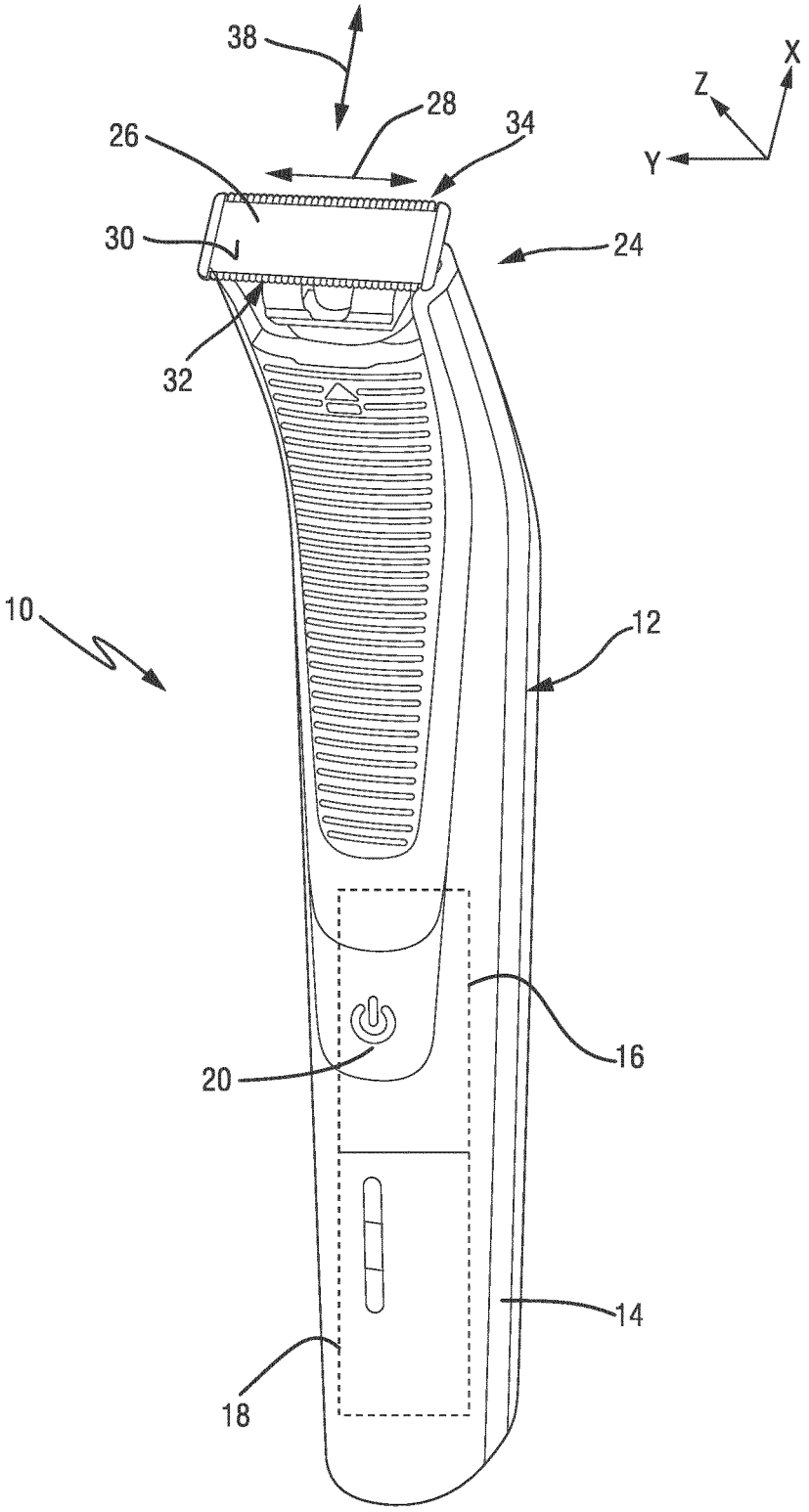
FIG. 1 shows a perspective frontal view of an exemplary embodiment of a hair cutting appliance.

FIG. 1 shows a perspective frontal view of a hair cutting appliance 10. The hair cutting appliance 10 is arranged as an appliance that is capable of both trimming and shaving.

The appliance 10 comprises a housing 12 which is arranged in an elongated fashion. At the housing 12, a handle section 14 is defined. In the housing 12, a drive unit 16 is arranged. Further, a battery 18 may be arranged in the housing 12. In FIG. 1, the drive unit 16 and the battery 18 are represented by dashed blocks. At the housing 12, operator controls 20 such as on/off buttons and the like may be provided.

At a top end thereof, the appliance 10 comprises a processing head 24 that is attached to the housing 12. The processing head 24 comprises a blade set 26. The blade set 26, particularly a movable blade thereof, may be actuated and driven by the drive unit 16 in a reciprocating fashion, refer also to the double arrow 28 in FIG. 1. As a result, respective teeth of the blades of the blade set 26 are moved with respect to one another, thereby effecting a cutting action. A top side or top surface of the blade set 26 is indicated by 30 in FIG. 1.

The blades of the blade set 26 may be arranged at a first leading edge 32 and, in at least some embodiments, at a second leading edge 34 that is opposite to the first leading edge 32. The first leading edge 32 may be also referred to as frontal leading edge. A second leading edge 34 may be also referred to as rear leading edge.

Further, a general advancing or moving direction of the appliance 10 is indicated in FIG. 1 by a double arrow 38. As the blade set 26 of the exemplary embodiment of FIG. 1 is equipped with two leading edges 32, 34, a push and a pull movement may be used to cut hair.

In the following, exemplary embodiments of stationary blades and blade sets 26 will be elucidated and described in more detail. The blade sets 26 may be attached to the appliance 10, or to a similar appliance. It goes without saying the single features disclosed in the context of a respective embodiment may be combined with any of the other embodiments, also in isolated fashion, thereby forming further embodiments that still fall under the scope of the present disclosure.

In some Figures shown herein, exemplary coordinate systems are shown for illustrative purposes. As used herein, an X-axis is assigned to a longitudinal direction. Further, a Y-axis is assigned to a lateral direction. Accordingly, a Z-axis is assigned to a vertical (height) direction. Respective associations of the axes/directions X, Y, Z with respective features and extensions of the blade set 26 can be derived from those Figures. It should be understood that the coordinate system X, Y, Z is primarily provided for illustrative purposes and not intended to limit the scope of the disclosure. This involves that the skilled person may readily convert and transform the coordinate system when being confronted with further embodiments, illustrations and deviating view orientations. Also a conversation of Cartesian coordinate systems into polar coordinate system may be envisaged, particularly in the context of a circular or curved blade set.

Figure 2:
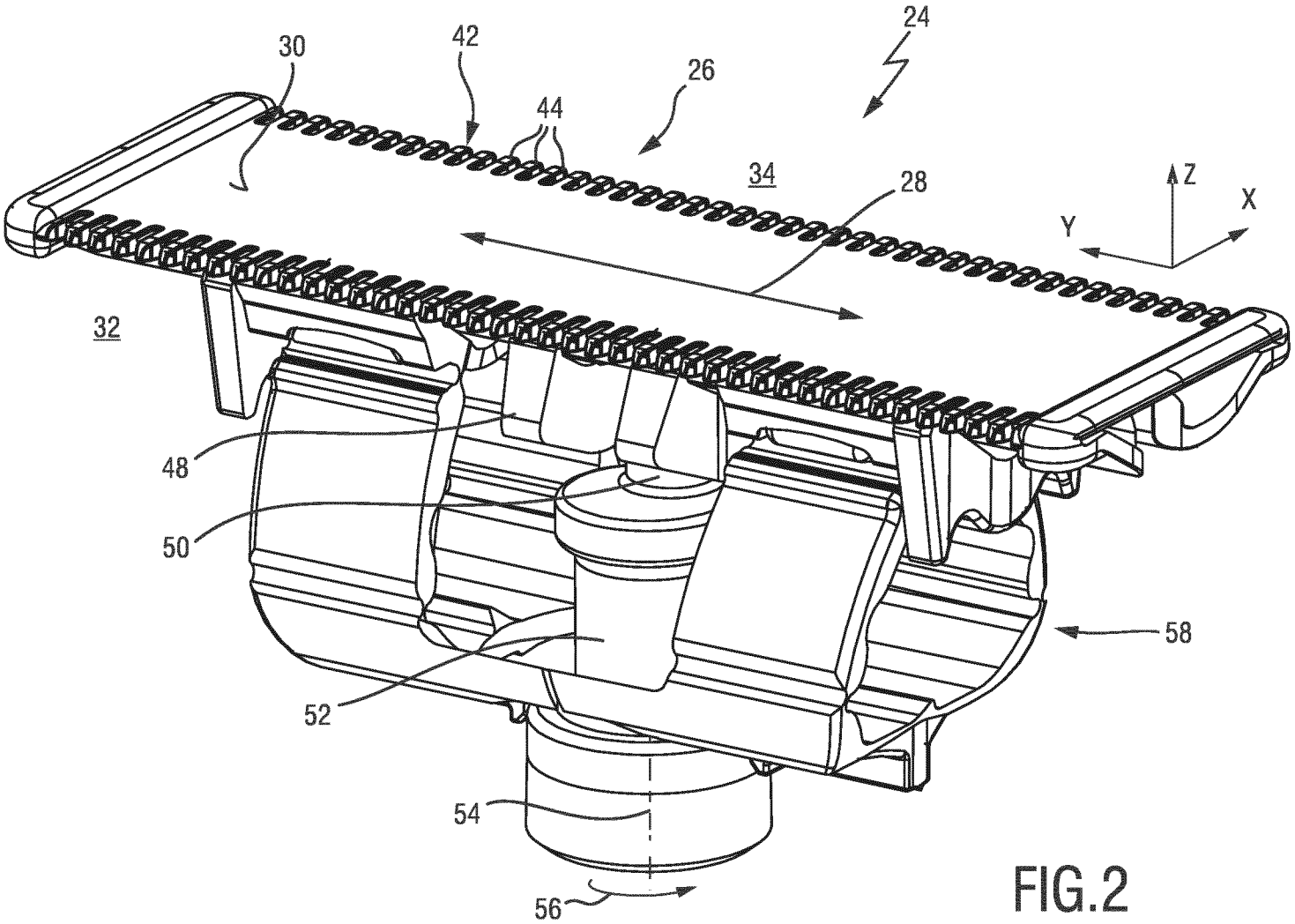
FIG. 2 shows a perspective top view of an exemplary embodiment of a blade set for a hair cutting appliance.

In FIG. 2, a perspective view of a blade set 26 for a processing head or cutting head 24 of a hair cutting appliance 10 is shown. As with the embodiment shown in FIG. 1, a cutting direction and/or a direction of a relative movement of blades of the blade set 26 is indicated by an arrow 28. A top side of the blade set 26 that is facing the user when the appliance 10 is operated is indicated by 30. In the exemplary embodiment shown in FIG. 2, the blade set 26 is provided with a first leading edge 32 and a second leading edge 34. In FIG. 2 a stationary blade 42 of the blade set 26 is shown. A movable blade (cutter blade) is covered by the stationary blade 42 in FIG. 2. Stationary blade teeth are indicated by 44.

The movable blade of the blade set 26 that is not visible in FIG. 2 is operated and actuated via a driving engagement element 48 that may also be referred to as driving bridge. At the element 48, a driving or engagement slot is formed that is engaged by a driving pin 50 of a driving shaft 52. The driving shaft 52 is rotated about a driving axis 54, refer to a curved arrow 56. The driving pin 50 is off-centered with respect to the driving axis 54. Consequently, as the driving pin 50 is revolving, a reciprocating movement of the movable blade with respect to the stationary blade 42 is effected.

In FIG. 2, there is further indicated a pivot mechanism 58 which may be referred to as a contour following feature. The mechanism 58 enables a certain pivot movement of the blade set 26 about the Y-axis.

With reference to FIGS. 3 to 14, exemplary insights and aspects of the present disclosure will be described and discussed in more detail. In particular, manufacturing aspects are discussed that contribute to the production of accurately and reliably operating blade sets that may be thus implemented in the appliance 10 as illustrated in FIG. 1, and/or the processing head 24 as illustrated in FIG. 2.

It is to be noted that FIGS. 3 to 14 illustrate schematic, simplified embodiments. For illustrative purposes, further components and/or details of the metal component and the support insert are omitted therein. For instance, the support insert may be provided with a slot for a driving element that extends therethrough and that engages the movable blade to transmit a driving movement to the movable blade.

Figure 3:
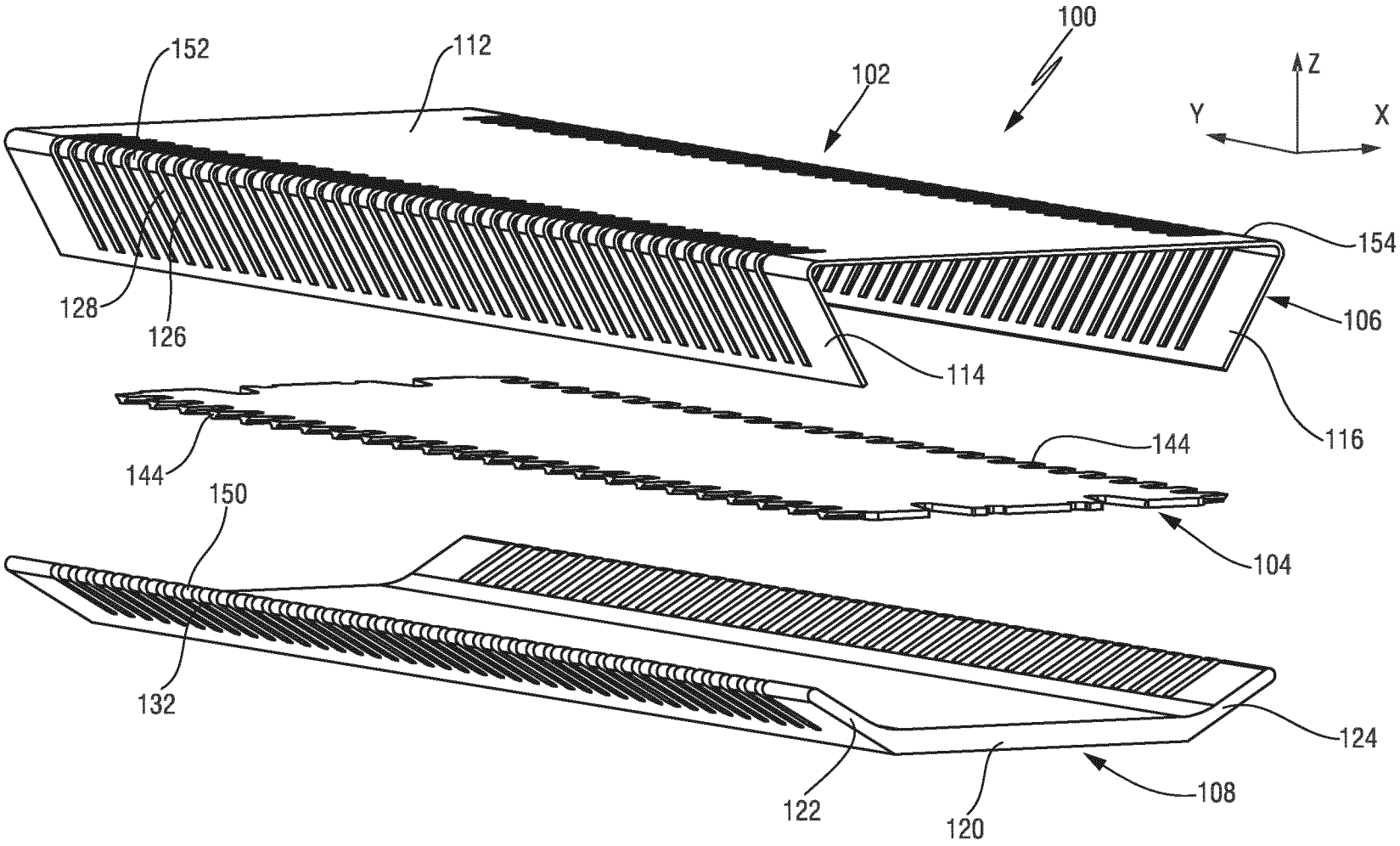
FIG. 3 shows an exploded perspective top view of a blade set in accordance with the present disclosure.
Figure 4:
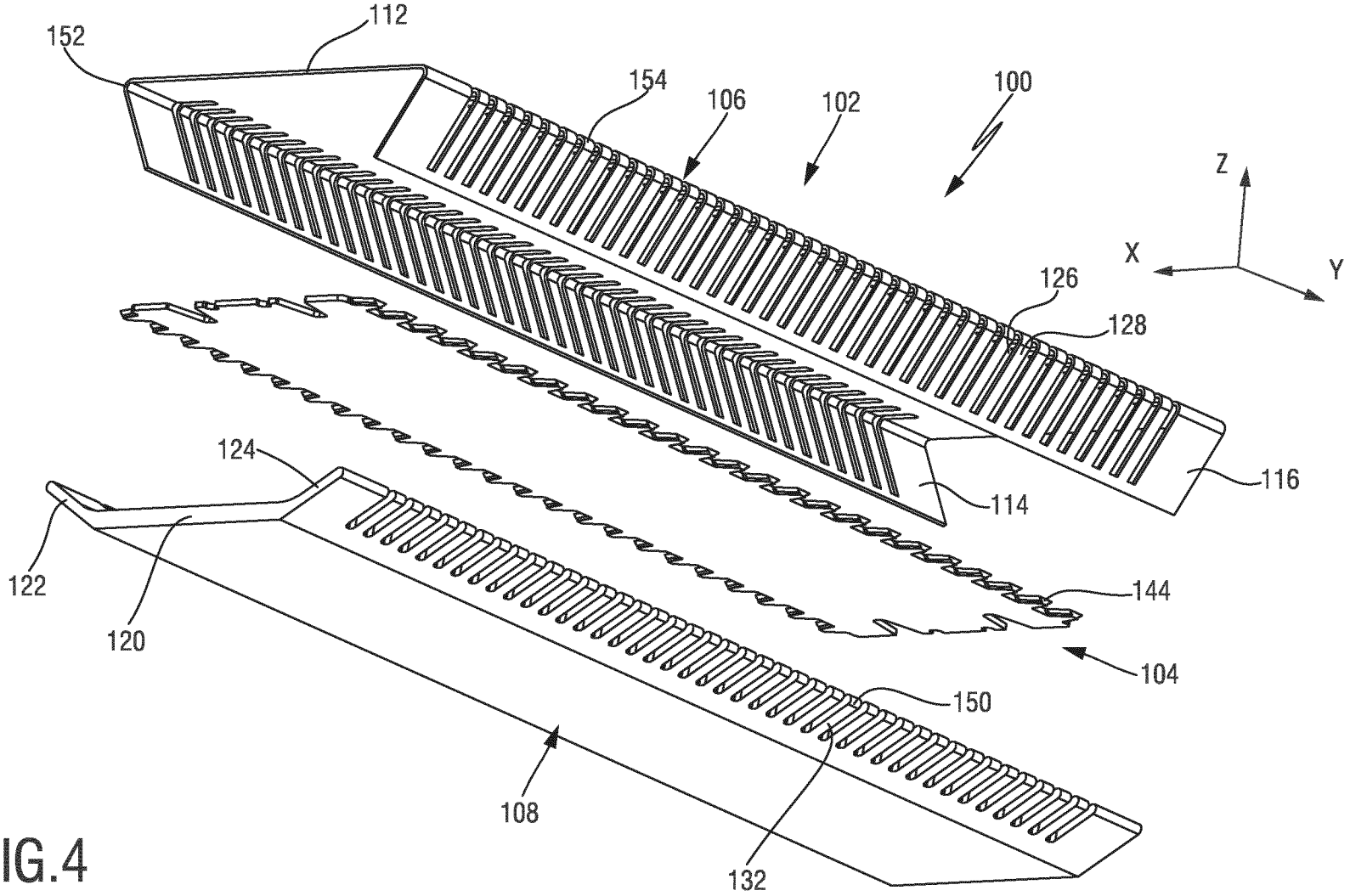
FIG. 4 shows an exploded bottom view of the arrangement of FIG. 3.

With reference to FIG. 3 and FIG. 4, a blade set 100 is shown that comprises a stationary blade 102 and a movable blade 104. Preferably, the blade set 100 is arranged to replace and/or augment the design of the blade set 26 illustrated in FIG. 2.

The blade set 100 is shown in FIG. 3 and FIG. 4 in exploded states. In FIG. 3, a perspective top view is provided, refer to the view orientation of FIG. 2. In FIG. 4, a perspective bottom view is shown.

This stationary blade 102 of the blade set 100 is a composed/assembled component. This stationary blade 102 comprises a metal component 106 and a support insert 108. As illustrated further herein below, the metal component 106 and the support insert 108 may be attached to one another to form the stationary blade 102, and to define a guide slot 110 therein that accommodates the movable blade 104, refer to FIG. 6 and to FIG. 14.

It is to be noted that in FIG. 3 and FIG. 4, the metal component 106 is shown in an intermediate assembly state. The metal component 106 may be obtained from a sheet metal blank.

The metal component 106 comprises a top wall 112 that is arranged as a skin-facing wall when the hair cutting appliance 10 that is equipped with the blade set 100 is operated to cut hair. At longitudinal ends of the top wall 112, a first leg 114 and a second leg 116 are provided that are originally flat portions that are bended/folded to be arranged at a defined angle with respect to the top wall 112.

The support insert 108 comprises a central portion 120 that is opposite to the top wall 112, and side arms 122, 124 that are contacted by the first leg 114 and the second leg 116 in the mounted state. In exemplary embodiments, the support insert 108 is an injection-molded plastic part. Therefore, mounting features and further elements may be integrally formed with the support insert 108 (not explicitly shown herein).

In the metal component 106, two opposite series of tooth slots 126 are formed that define in the final assembly state a series of tooth portions 128. At the support insert 108, tooth stems 132 are formed that are aligned with respective tooth portions 128 of the metal component. In the finally assembled state of the stationary blade 102, the tooth portions 128 and the tooth stems 132 form stationary blade teeth 136.

As with the arrangement illustrated in FIG. 2, also the blade set 100 comprises a first leading edge 138 and a second leading edge 140 each of which is provided with a respective series of teeth 136.

At the movable blade 104, movable blade teeth 144 are formed. The movable blade teeth 144 cooperate with the stationary blade teeth 136 to cut hair when the movable blade 104 is operated to be moved with respect to the stationary blade 102.

The blade set 100 that is provided with the stationary blade 102 may be operated for trimming purposes. However, as the metal component 106 may be considerably thin, at least in some embodiments, the blade set 100 is also operable for shaving operations where a very close skin contact is preferred to achieve a smooth and freshly shaved appearance.

To make the metal component 106 considerably thin, the support insert 108 is provided to strengthen the stationary blade 102. In isolation, the metal component 106 would be too flexible to efficiently cooperate with the movable blade 104.

Figure 6:
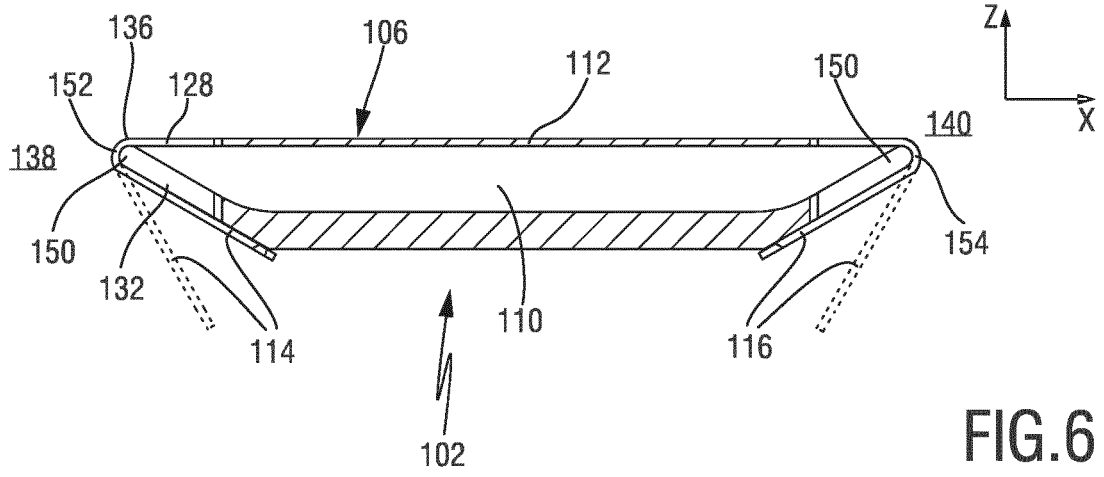
FIG. 6 is a cross-sectional lateral view along the line VI-VI in FIG. 5.
Figure 5:
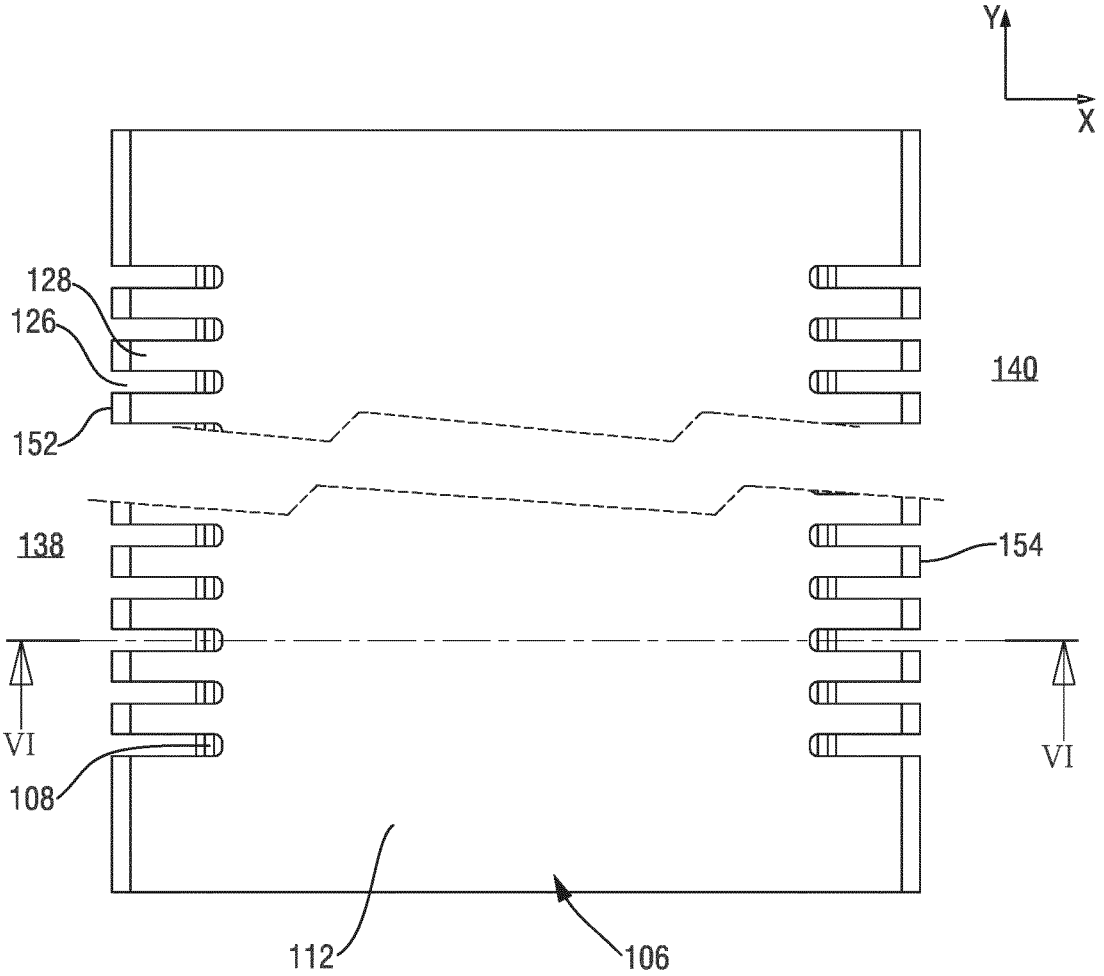
FIG. 5 shows a simplified broken top view of a stationary blade for a blade set as shown in FIG. 3.

FIG. 6 illustrates the guide slot 110 that is defined by the metal component 106 and the support insert 108. To provide a reliable connection between the metal component 106 and the support insert 108, the first leg 114 and the second leg 116 are bent in such a way that the support insert 108 is caught or clamped between the first leg 114 and the second leg 116. In other words, the first leg 114 and the second leg 116 are folded back to form a clamping holder for the support insert 108. As the support insert 108 is much thicker than the metal component 106, the support insert 108 may be regarded as a basically rigid component so that the support insert 108 does not collapse due to the bias applied by the metal component 106.

The first leg 114 and the second leg 116 are bent about bending shoulders 150 that are formed at the tips of the tooth stems 132. Consequently, tips of the tooth portions 128 of the movable blade 104 that are formed at the transition between the top wall 112 and the two legs 114 and 116, respectively, contact the shoulders 150. At the first leading edge 138, the bending edge 152 is formed. At the second leading edge 140, the bending edge 154 is formed.

Figure 11:
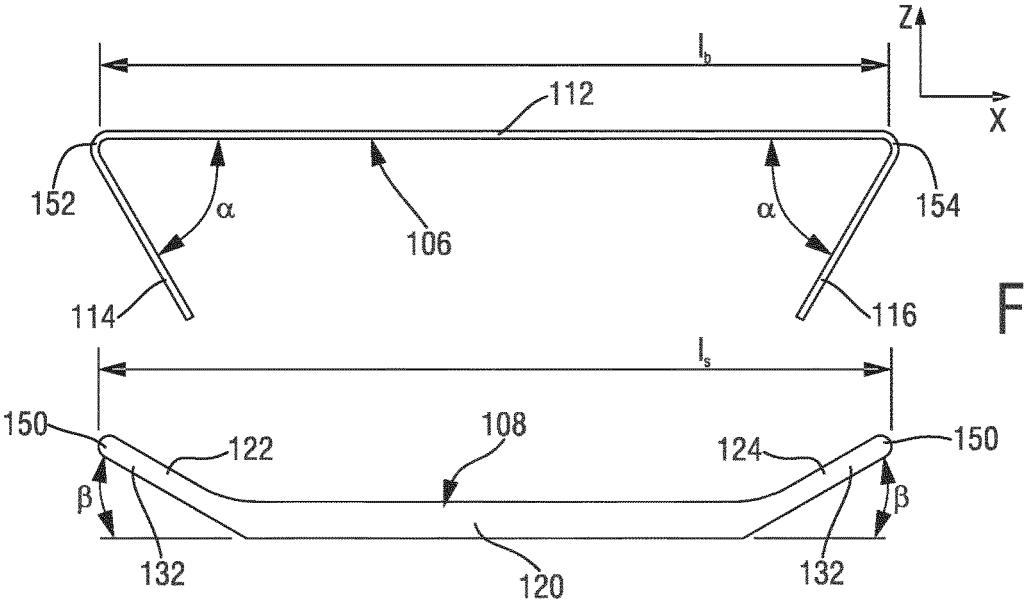
FIG. 11 illustrates an intermediate metal component and a support insert for the formation of a stationary blade, in a detached state prior to assembling.

FIG. 6 further illustrates by means of a dashed representation intermediate positions of the legs 114, 116 after the first bending procedure, refer also to FIG. 11. So is it clear that basically opposite deformation procedures are involved to achieve the final assembly state of the legs 114, 116.

Several constraints have to be considered for the manufacture of the stationary blade 102. In this context, reference is made to FIGS. 7 to 14, each showing a lateral view of components to be used in the manufacture of blade sets for hair cutting appliances.

Figure 7:
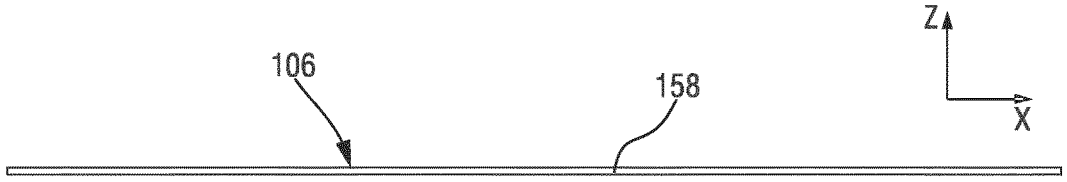
FIG. 7 shows a simplified lateral view of a sheet metal blank from which a metal component for a stationary blade may be formed.

FIG. 7 shows a sheet metal blank 158 having a basically planar shape. From the sheet metal blank 158, metal components 106 may be obtained. In the flat and even state as shown in FIG. 7, the slots 126 may be processed in the sheet metal blank 158 to define the series of stationary blade teeth 136 that results from the manufacturing procedure.

Figure 8:
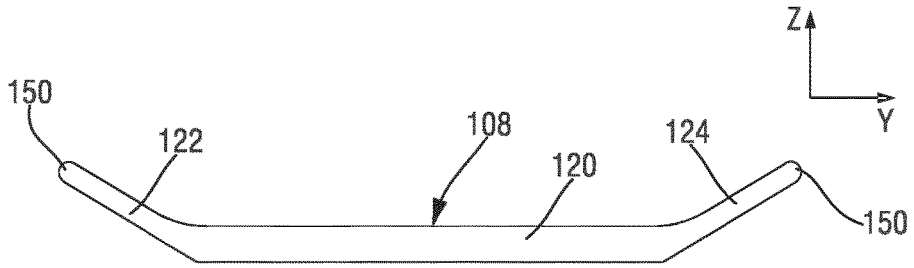
FIG. 8 shows a support insert that forms a component of a stationary blade.

FIG. 8 shows a lateral view of the support insert 108 that is to be assembled with the originally flat sheet metal blank 158.

Figure 9:
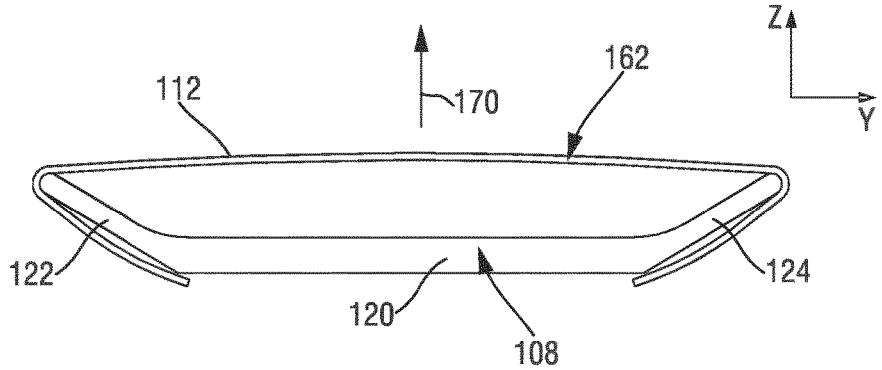
FIG. 9 shows for illustrative purposes an incorrectly manufactured stationary blade, due to an incorrectly assembled/attached metal component.
Figure 10:
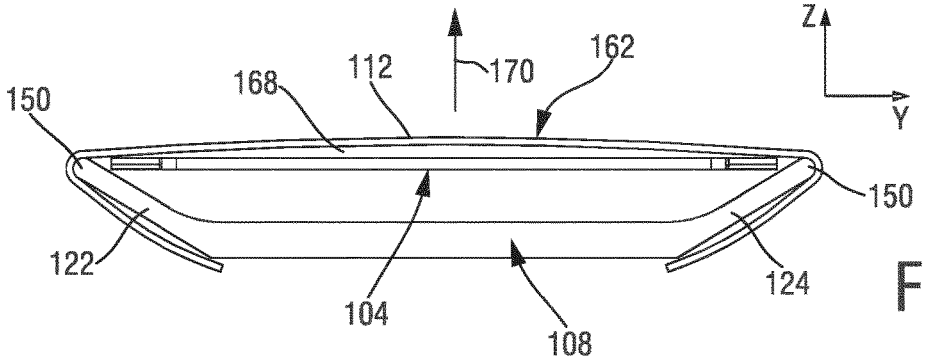
FIG. 10 shows an incorrectly manufactured blade set that results from the arrangement of FIG. 9.

With reference to FIG. 9 and FIG. 10, an incorrect and defective manufacturing approach is illustrated. When the support insert 108 is used as the primary bending gage for the folding procedure applied to the sheet metal blank 158 as shown in FIG. 7 without any intermediate bending procedure, quite likely a result as shown in FIGS. 9 and 10 will be achieved. In FIG. 9, an incorrectly manufactured metal component 162 is shown that forms an incorrectly produced stationary blade 164. The main reason for the convexly shaped/domed appearance of the metal component 162 is that the sheet metal blank 158 has been bent about the shoulders 150 of the side arms 122, 124 of the support insert 108 without any further preparation and/or intermediate bending procedure. The sheet metal material the metal component 162 is formed from is considerably resilient. Hence, the bending procedure has a negative impact also on the shape and evenness of the top wall 112. The bending force applied to the first leg 114 and the second leg 116 induces a reaction that induces an outward doming of the top wall 112. An arrow 170 illustrates the doming effect.

As a result, the cutting performance may be significantly deteriorated as a certain gap 168 is present in the finally assembled state of such an incorrectly produced blade set 166, refer to FIG. 10. The movable blade 104 is basically rigid and designed to be substantially planar. Hence, a huge gap 168 is formed in a central region of the blade set 166. In the cutting zone, where the stationary blade teeth 136 and the movable blade teeth 144 cooperate, at least a slight gap or offset is present between the metal component 162 and the movable blade 104. To achieve a great cutting performance, however, a close and basically parallel contact between the cutting edges of the stationary blade teeth 136 and the movable blade teeth 144 is preferred.

With reference to FIGS. 11 to 14, an alternative manufacturing approach within the context of the present disclosure will be described that may result in a better cutting performance due to an improved dimensional stability of the metal component 106 of the stationary blade 102. The approach as discussed hereinafter may also use the sheet metal blank 158 shown in FIG. 7 and the support insert 108 shown in FIG. 8.

In FIG. 11, an intermediate manufacturing state involving a still detached state of the metal component 106 and the support insert 108 is illustrated. In contrast to the approach illustrated in FIG. 9 and FIG. 10, a first bending procedure is applied to the metal component 106 before fitting it onto the support insert 108. As a result, the first leg 114 and the second leg 116 are arranged at an angle $\alpha$ (alpha) with respect to the top wall 112. As shown in FIG. 11, the angle $\alpha$ is an inner angle that is defined in a region where the top wall 112 and the two legs 114, 116 face one another. It is noted that the bending angle is a complementary angle ($180°-\alpha$).

The initial bending procedure defines a certain dimension between the bending edges 152, 154. In FIG. 11, the resulting mounting space is indicated by $l_b$.

In FIG. 11, there is further shown a lateral view of the support insert 108. The side arms 122, 124 of the support insert 108 are arranged at an angle $\beta$ (beta) with respect to the main extension (longitudinal extension) of the central portion 120. The angle $\beta$ is smaller than the bending angle $\alpha$ of the metal component 106. Further, the opposite shoulders 150 of the side arms 122, 124 (or the tooth stems 132), define a longitudinal extension $l_s$. In accordance with major embodiments, the mounting space $l_b$ is at least slightly smaller than the longitudinal extension $l_s$ ($l_b<l_s$).

In other words, the metal component 106 and the support insert 108 may only be assembled to one another when a certain clamping force due to the interference between the dimensions $l_b$, $l_l$ is borne by the metal component 106.

Figure 12:
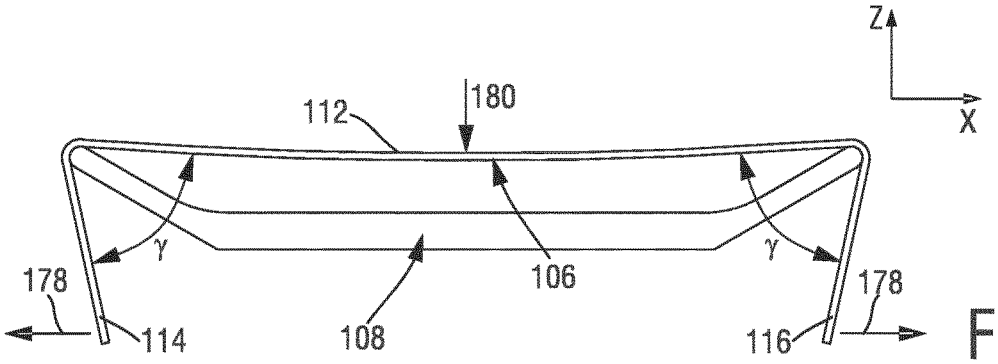
FIG. 12 shows the components of FIG. 11 in an intermediate assembly state.

The resulting intermediate assembly state is illustrated in FIG. 12. The metal component 106 and the support insert 108 are already force-fitted to one another, due to the dimensional interference. A result of the interference between the mounting space $l_b$ of the metal component 106 and the longitudinal extension $l_s$ of the support insert 108 is that the first leg 114 and the second leg 116 are bent contrary to their initial intermediate bending. A resulting angle is indicated in FIG. 12 by γ (gamma). In other words, a certain deformation (folding out) indicated by the arrows 178 in FIG. 12 happens to the first leg 114 and the second leg 116. As the metal component 106 is made from relatively elastic and resilient material, the resulting deformation also continues at the top wall 112. As indicated by an arrow 180, the top wall 112 is inwardly domed, due to the interference fit of the metal component 106 and the support insert 108.

Figure 13:
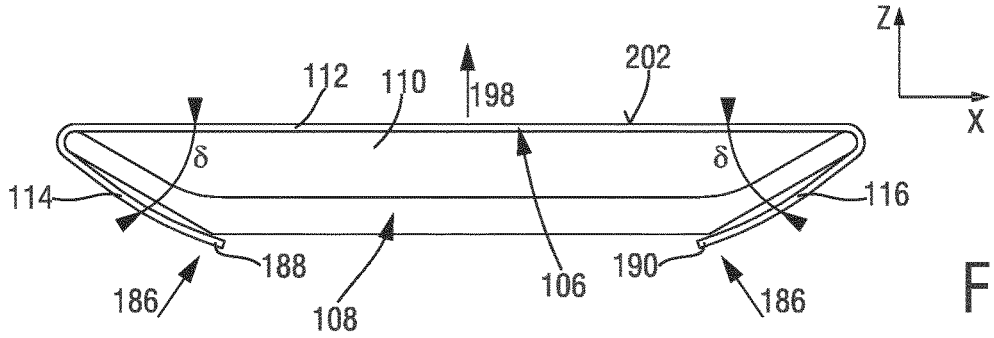
FIG. 13 shows the arrangement of FIG. 12 in an advanced assembly state.

To accomplish the assembly and manufacturing procedure, a further bending procedure is necessary to connect the first leg 114 and the second leg 116 with their counterpart side arms 122, 124, refer to FIG. 13. To this end, a certain fixation force 186 is applied to the first leg 114 and the second leg 116. Due to the elasticity of the metal material, at least in some embodiments, connector portions 188, 190 of the legs 114, 116 are fixedly attached to the support insert 108. This may involve a welding procedure, a bonding procedure, a gluing procedure, etc. In any case, it is necessary to permanently apply the fixation force 186 to avoid a rebound of the first leg 114 and the second leg 116, i.e. a disengagement from opposite bottom sides of the side arms 122, 124.

The connector portions 188, 190 may be arranged as outermost (inward) points of the first leg 114 and the second leg 116. Hence, a considerably large lever arm is present so that the required fixation force 186 is not too large.

As illustrated in FIG. 13, it is not necessary to achieve a planar shape and contact for the first leg 114 and the second leg 116. Rather, a contact at the connector portions 188, 190 is sufficient.

The fixation force 194, 196 induces a reaction/continuation along the extension of the metal component 106. As a result, an outward doming effect is present at the top wall 112, refer to the arrow 198. In other words, the doming effect already discussed in accordance with FIG. 9 and FIG. 10 is still present, with the difference that an opposite deformation of the top wall 112 has been induced before. Preferably, the inward doming 180 shown in FIG. 12 and the outward doming 198 shown in FIG. 13 are similar or equal in terms of the induced deformation. As a result, a basically planar surface 202 that is sufficiently even may be provided at the top wall 112.

Figure 14:
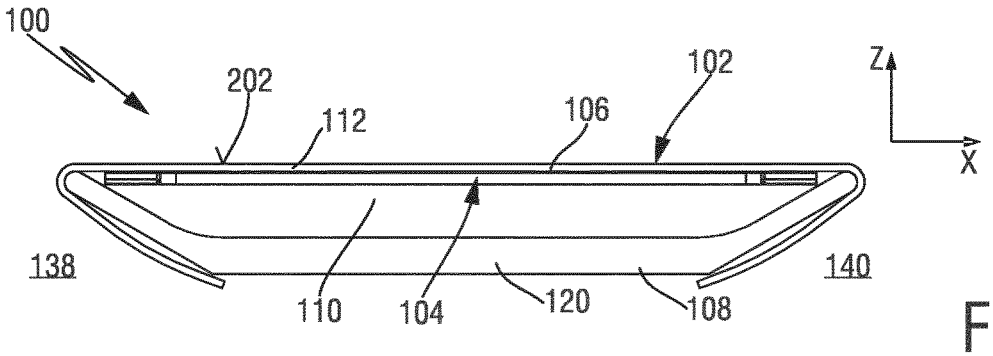
FIG. 14 shows a blade set for a hair cutting appliance that results from the arrangement of FIG. 13.

As shown in FIG. 14, a tight contact between the top wall 112 and the movable blade 104 is possible when the top wall 112 is basically planar and not considerably deformed during the manufacturing and assembling procedure.

The above-described approach has the benefit that deformations that are always present when bending procedures are involved may be compensated so that dimensionally stable components may be achieved even though relatively simple and cost-effective production and assembly processes are used.

Figure 15:
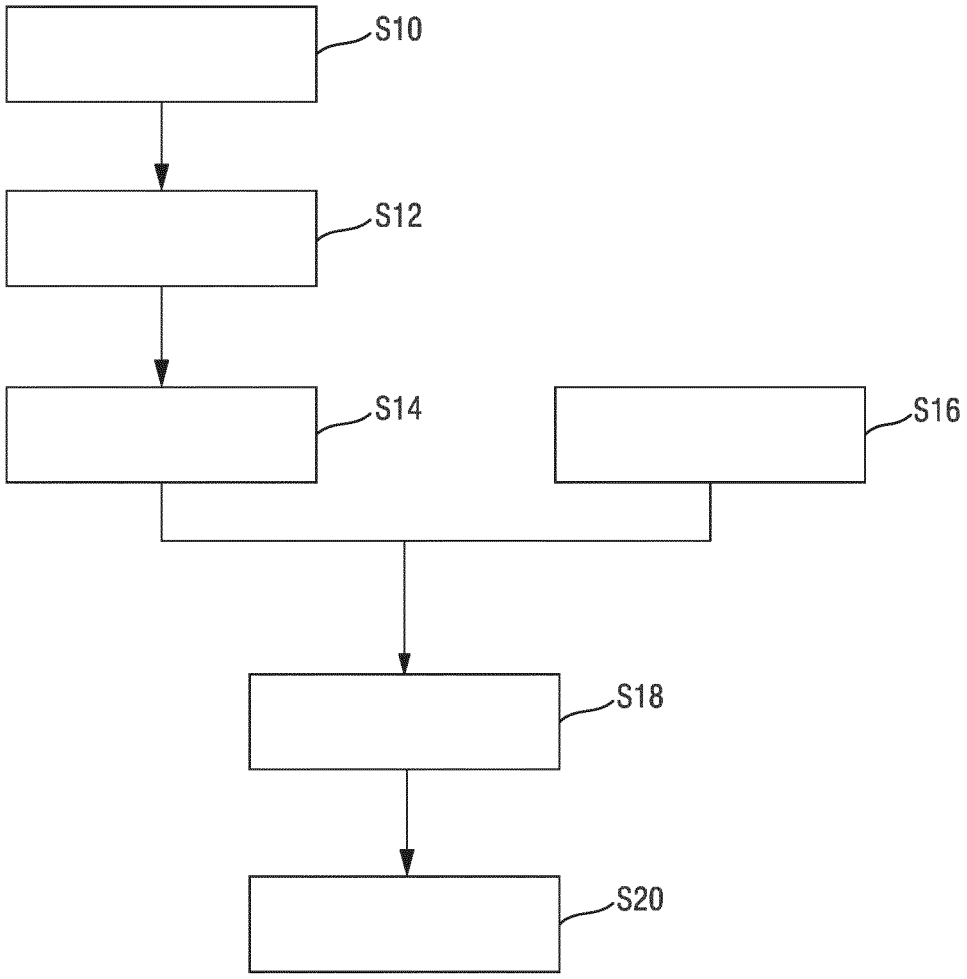
FIG. 15 shows a block diagram illustrating an exemplary embodiment of a method of manufacturing a stationary blade for a blade set for a hair cutting appliance in accordance with the present disclosure.

Further reference is made to FIG. 15, schematically illustrating an exemplary embodiment of a method of manufacturing a stationary blade for a blade set of a hair cutting appliance.

In a first step S10, a sheet metal blank is provided based on which a metal component is formed. The step S10 may involve, for instance, stamping, cutting, etching, and similar manufacturing processes.

In a further, subsequent step S12, at least one pattern of slots is formed in the sheet metal blank. Preferably, two opposite patterns of slots are formed. In the final manufacturing state, the pattern of slots defines a series of teeth. The slots may be formed by cutting, particularly laser cutting, etching (electro-chemical processing), cutting, stamping, etc.

In a subsequent step S14, a first bending procedure is applied to the initially flat sheet metal blank. In the step S14, a top wall and two opposite legs are formed. The first bending procedure involves a bending of the slots so that bending edges are defined that form tooth portions in a downstream manufacturing step. The metal component obtained through the steps S10 to S14 is clamp-shaped and arranged to be coupled with a support insert.

In a further step S16, such a support insert is provided. The step S16 may involve injection-molding the support insert. The support insert may comprise central portions and two opposite side arms extending therefrom that are inclined with respect to the central portion. At the side arms, tooth stems may be formed that cooperate with the tooth portions of the metal component to form stationary blade teeth in the finally assembled state.

In a further step S18, the metal component and the support insert are assembled. This may involve an insertion of the support insert in a receiving space defined between the first leg and the second leg of the metal component. In this regard, the support insert has an extension that is at least slightly larger than the receiving space provided between the first leg and the second leg of the metal component.

As a result, a pretensioning and a deformation of the metal component is present that is opposite to the initial bending procedure applied in the step S14. This has the effect that also the top wall between the first leg and the second wall is at least slightly deformed. This deformation may be regarded as a preparation for a further deformation induced at the top wall due to the final assembly step S20. In the step S20, the two legs of the metal component are bent further so that connector portions thereof contact the side arms of the support insert. Optionally, the step S20 may involve a fixation of the connector portions at the side arms. A resulting deformation is opposite to the deformation of the top wall induced in the step S18.

Ultimately, a basically flat and even top wall may be achieved which qualifies the stationary blade for an improved cutting performance.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A method of manufacturing a stationary blade for a blade set of a hair cutting appliance, the method comprising:

providing a metal component, comprising:

providing a sheet-metal blank, forming at least one pattern of slots in the sheet-metal blank, and applying a first bending procedure to the metal component, thereby forming a top wall and two legs at opposite ends of the top wall that are spaced from each other in a longitudinal direction, wherein, subsequent to the first bending procedure, each of the two legs is arranged at a first angle with respect to the top wall, and wherein two bending edges are formed between the top wall and the two legs, providing a support insert having a longitudinal extension that is at least slightly greater than a receiving space between the two bending edges, joining the metal component and the support insert, wherein the metal component is at least slightly pretensioned in the longitudinal direction, due to the longitudinal extension of the support insert, and applying a second bending procedure to the metal component, comprising further bending the two legs, thereby arranging each of the two legs at a second angle with respect to the top wall that is smaller than the first angle, wherein the second bending procedure at least partially compensates an intermediate deformation of the top wall that is caused by the pretensioning of the metal component.

2. The method as claimed in claim 1, wherein the step of joining the metal component and the support insert induces the intermediate deformation of the top wall, and wherein the second bending procedure induces an opposite deformation.

3. The method as claimed in claim 1, wherein the top wall, subsequent to the step of joining the metal component and the support insert and prior the second bending procedure, is inwardly domed, when viewed in a cross-sectional plane perpendicular to a lateral direction.

4. The method as claimed in claim 1, wherein the top wall, subsequent to the second bending procedure, is basically planar, when viewed in a cross-sectional plane perpendicular to a lateral direction.

5. The method as claimed in claim 1, wherein in the second bending procedure the two legs are urged against the support insert.

6. The method as claimed in claim 1, wherein the support insert comprises two side arms and a central portion extending therebetween, wherein the side arms are inclined and arranged at an angle with respect to the central portion that defines a target position for the two legs of the metal component.

7. The method as claimed in claim 1, wherein subsequent to the second bending procedure, the legs of the metal component are secured at the support insert.

8. The method as claimed in claim 1, wherein the first bending procedure and the second bending procedure form stationary blade teeth that are, when viewed in a cross-sectional plane perpendicular to a lateral direction, substantially U-shaped or V-shaped and that are respectively formed by the top wall and one of the two legs.

9. The method as claimed in claim 1, wherein the metal component and the support insert form therebetween a guide slot for a movable blade.

10. A stationary blade for a blade set of a hair cutting appliance, comprising:

a metal component obtained from a sheet metal blank, and a support insert, wherein the metal component is folded around the support insert and forms a first folded edge at a first longitudinal end and a second folded edge at a second longitudinal end, wherein the metal component comprises a top wall and two legs at opposite ends of the top wall that are spaced from each other in a longitudinal direction, wherein the support insert is retained between the top wall and the two legs, wherein the metal component and the support insert form therebetween a guide slot for a movable blade, wherein, at the folded edges, at least one series of metal teeth is formed by the metal component, wherein tooth stems provided at the support insert form shoulders for the folded edges, wherein the top wall is pretensioned in the longitudinal direction by the support insert, and wherein a first of the two legs and a second of the two legs are bent about the shoulders in such a way that a deformation of the top wall due to the pretensioning is at least partially compensated so that the top wall is basically planar, wherein the legs of the metal component are, at their end portions, sectionally bonded to the support insert, and wherein an adjacent portion of each of the legs is at least sectionally outwardly domed so that a clearance between the domed section and the support insert is present.

11. The stationary blade as claimed in claim 10, wherein the first leg and the second leg, in their assembled state, are preloaded so that a compensating bending moment acts on the top wall.

12. The stationary blade as claimed in claim 10, wherein the legs of the metal component are secured at the support insert.

13. The stationary blade as claimed in claim 10, wherein the support insert comprises two side arms and a central portion extending therebetween, wherein the side arms are inclined and arranged at an angle with respect to the central portion that defines a target position for the two legs of the metal component.

14. A blade set for a hair cutting appliance, the blade set comprising:

a stationary blade as claimed in claim 10, and a movable blade comprising a plurality of movable blade teeth, wherein the movable blade is movably retained between the metal component and the support insert in an assembled state, and wherein the movable blade is arranged to be moved with respect to the stationary blade to cut hair.

* * * * *